United States Patent [19]

Brunner et al.

[11] Patent Number: 4,898,337

[45] Date of Patent: Feb. 6, 1990

[54] THREAD STORING AND SUPPLYING DEVICE FOR TEXTILE MACHINES, PARTICULARLY KNITTING MACHINES

[75] Inventors: Heinz Brunner, Albstadt-Ebingen; Karl-Jürgen Sauter, Messstetten, both of Fed. Rep. of Germany

[73] Assignee: Sipra Patententwicklungs-Und Beteiligungsgesellschaft, Tailfingen, Fed. Rep. of Germany

[21] Appl. No.: 244,807

[22] Filed: Sep. 14, 1988

[30] Foreign Application Priority Data

Oct. 7, 1987 [DE] Fed. Rep. of Germany ..... 3733797

[51] Int. Cl.[4] ..... B65H 59/22; B65H 51/20

[52] U.S. Cl. ..... 242/151; 66/132 T; 66/163; 242/47.01

[58] Field of Search ..... 242/47.01, 47.02, 47.03, 242/47.04, 47.05, 47.06, 47.07, 47.08, 47.09, 47.1, 47.11, 47.12, 47.13, 47, 151, 152, 129.8, 36; 66/132 R, 132 T, 163; 139/452; 28/222, 223, 224, 226, 231, 232, 235

[56] References Cited

U.S. PATENT DOCUMENTS 2,362,920 11/1944 Moore ..... 242/151 X
3,490,710 1/1970 Muhlhausler ..... 242/47.01
4,681,272 7/1987 Brunner et al. ..... 242/47.01
4,754,936 7/1988 Dalmau Guell et al. ..... 242/47.01

*Primary Examiner*—Stanley N. Gilreath
*Attorney, Agent, or Firm*—Michael J. Striker

[57] ABSTRACT

A thread storing and supplying device for textile machines, especially knitting machines comprises a housing, a driveable thread storage drum provided in the housing for supporting several windings of a thread, a thread guiding element arranged to supply a thread to the thread storage drum, and a thread brake and a knot monitor which together form a combined thread braking and knot monitoring unit located immediately after the thread guiding element as considered in a thread running direction this thread braking device includes two freely rotatable axes-parallel rollers, one of the rollers being displaceable relative to another of the rollers which is non-displaceable against a braking spring force the thread braking device also has an adjustable abutment which defines a maximum displacement value for the gap between the rollers, and the non-displaceable roller is arranged so a thread is deflected over it. The displaceable roller is mounted on a supporting means which is pivotally mounted on the housing.

10 Claims, 3 Drawing Sheets

THREAD STORING AND SUPPLYING DEVICE FOR TEXTILE MACHINES, PARTICULARLY KNITTING MACHINES

BACKGROUND OF THE INVENTION

The present invention relates to a thread storing and supplying device for textile machines, especially knitting machines. More particularly, it relates to a device of the above mentioned type which has a housing with a driveable thread storage drum for supporting several windings of a thread supplied from and to thread guiding elements, as well as a knot monitor located before the thread storage drum and especially our invention relates to an adjustable thread braking device.

So-called furnishers of the above mentioned general type are known in many various forms. Threads are supplied to these devices through thread guiding eyes on which a thread deviation is performed. Thread braking devices which are arranged on the housings of the devices are predominantly formed as an adjustable disc brake. In addition, a knot monitor can also be provided. Knot monitors, which are conventionally used are such monitors in which the thread guiding gap is limited at least at its one side by a rigid part. All the above mentioned parts produce higher or lower thread wear which depends on the processed thread material, and form therefore fiber fuzz. The fiber fuzz can dirty the above mentioned elements or runs together with the yarn in an undesirable manner to the thread storage drum on which the fuzz forms a fiber ring.

SUMMARY OF THE INVENTION

Accordingly, it is an object of the present invention to provide a thread storing and supplying device and especially a thread braking device which avoids the disadvantages of the prior art.

More particularly it is an object of the present invention to provide a thread storing and supplying device of the above mentioned general type which is formed so that it has a low number of elements for thread control and thread guidance at the thread inlet side and also designed so that the fuzz formation is substantially suppressed.

In keeping with these objects and with others which will become apparent hereinafter, one feature of the present invention resides, briefly stated, in a thread storing and supplying device in which the thread brake which is located immediately after the thread guiding element on a housing of the device, is combined with a knot monitor so as to form a thread braking and monitoring unit, and the unit includes two freely rotatably supported axes-parallel rollers wherein one roller is displaceable relative to another non-displaceable roller against a braking spring force, the maximum displacement of the displaceable roller is limited by an adjustable abutment, and the thread is deviated over a non-displaceable roller.

The thus designed thread storing and supplying device is therefore provided with a combination of a thread brake and a knot monitor formed as a unit or thread braking device and having such construction that practically no thread wear occurs, and their rotatable rollers prevent the depositing of fiber fuzz. The arrangement of the thread braking rollers directly behind the thread guiding element, which can be advantageously on the end of a thread guiding pipe, provides for the advantage that this thread guiding element which is conventionally formed as a rigid thread guiding eye is substantially relieved from its thread guiding function and thereby no fuzz is formed on it. The non-displaceable roller of the combined braking and thread monitoring unit forms a thread-saving deviating element which takes up the thread tensioning forces characterized by variation peaks so that the changes in the thread tensioning cannot influence the operation of the thread brake.

The thread storing and supplying in accordance with the present invention facilitates its operation, especially when the rollers of the thread-braking device are supported so that one roller is at least partially pivotally mounted so that it can be swung or pivoted to or from the other roller. This facilitates the insertion of thread. A thread which is thrown through the thread guiding pipe to the rollers by means of air can therefore be laterally introduced between both rollers.

In accordance with another advantageous feature of the present invention, the displaceable roller of the thread braking device can be supported on a free end of a turning arm which is arranged in the housing and engaged by a spring which in turn is also arranged on the housing and has an adjustable force. An adjustable abutment which is also arranged in the housing also acts on it.

In accordance with a further advantageous feature of the present invention, the braking force and the maximum throughgoing gap between both rollers can be changed independently of one another. For this purpose advantageously two special adjusting screws can be provided in the housing, and the contact point of the braking spring and the abutment point of the abutment can have different distances from a pivot point of the turning arm. The braking spring can be arranged at a location which is favorable for the turning moment on the turning lever.

The threads can be supplied from the combined braking and thread monitoring unit radially and tangentially to the thread storage drum. The thread sensing element which is conventionally arranged between the thread brake and the thread storage drum and provided with a sensing lever abutting against a running thread can cause only an insignificant fuzz formation. The fuzz which is supplied through the thread guiding pipe is practically completely removed from the threads on the rollers of the combined braking and knot monitoring unit. Thereby fuzz-free threads are supplied to the thread storage drum. In addition to the solution of the respective objects, the device in accordance with the present invention provides elements which improve the braking devices used on furnishers with respect to the uniformity of the braking force as well as the knot monitors which conventionally produce an additional fuzz forming location.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
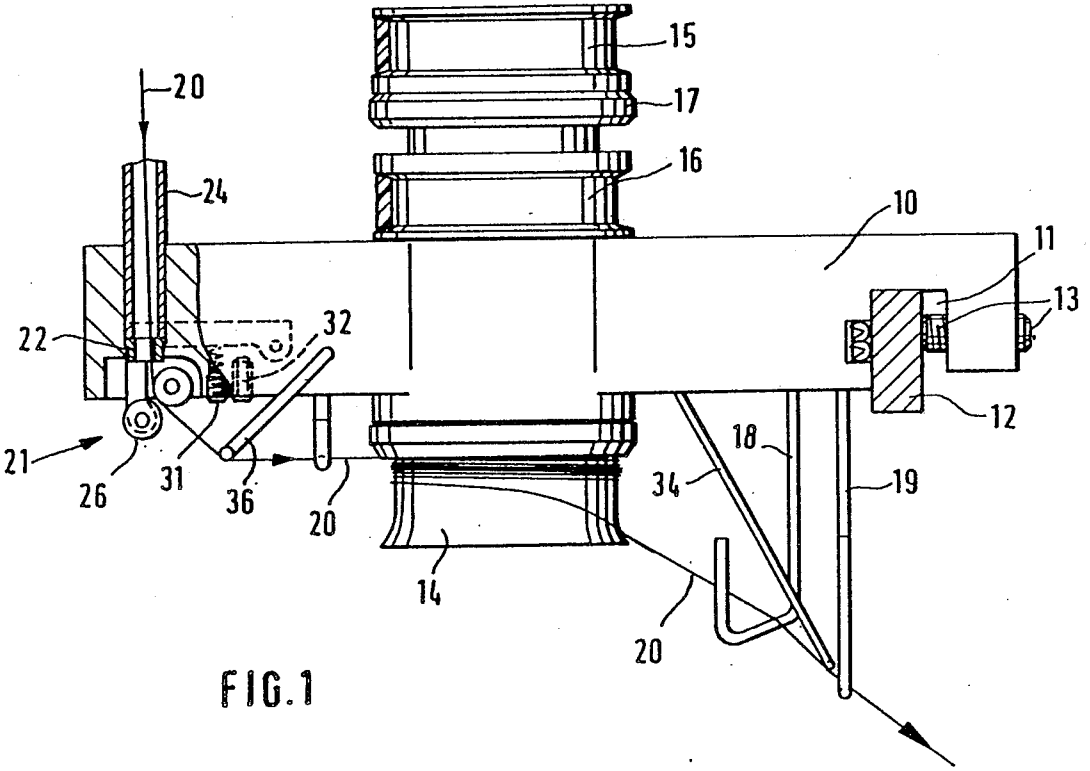
FIG. 1 is an elevational view showing a thread storing and supplying device in accordance with the present invention, partially sectioned at its front end.

A thread storing and supplying device for textile machines, especially knitting machines in accordance with the present invention has an elongated housing 10 which is formed as a hollow body and not shown in detail. The housing 10 is provided near its one end with a recess 11 for inserting a mounting rail 12 of texile machine.

The housing 10 is clamped on the mounting rail 12 by a clamping screw 13. A thread storage drum 14 is arranged on the one side of the housing and fixedly connected with a not shown shaft which extends vertically through the housing 10 and supported in the latter. Two belt pulleys 15 and 16 are supported on the shaft part which extends beyond the upper surface of the housing 10. The belt pulleys 15 and 16 are selectively coupleable in a known manner with the shaft and thereby with the thread storage drum 14 by an axially displaceable coupling disc 17 which s located between the belt pulleys 15 and 16.

Two thread guiding brackets 18 and 19 are arranged on the lower side of the housing 10 one behind the other and behind the thread storage drum 14 as considered in a thread running direction. A thread 20 which is tangentially moved from the thread storage drum 14 is guided over the thread guiding brackets 18 and 19. A sensor formed as a turning lever 34 is supported in the housing 10 and abuts against the thread between the thread guiding brackets 18 and 19. The sensor is a part of a known thread monitoring device. When the turning lever 34 falls from its position shown in FIG. 1 because of absence of the thread 20, a switch of the control of the device is actuated and the textile machine is turned off.

Figure 2:
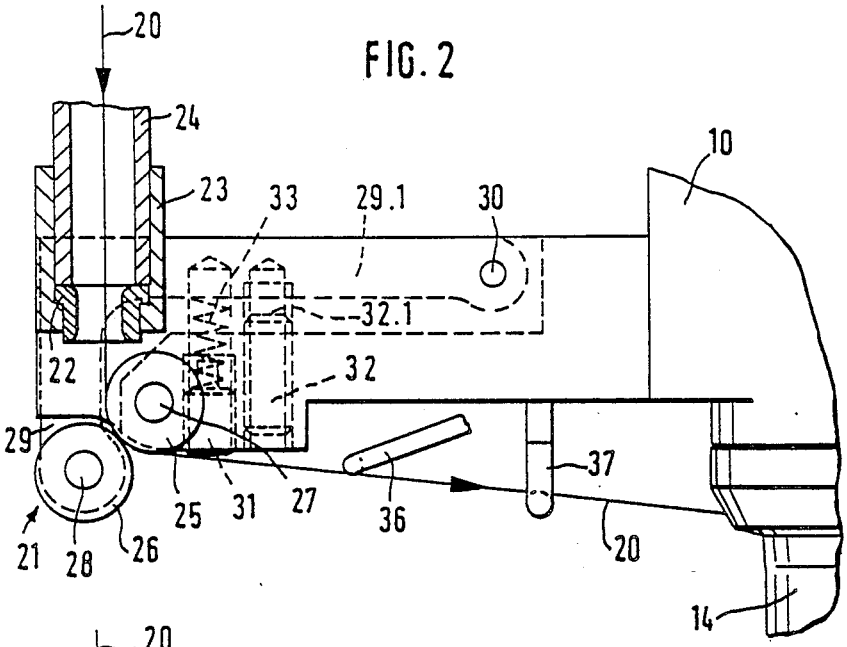
FIG. 2 is an elevational view showing the front end of the device in accordance with the present invention, on an enlarged scale and in a normal operating position.

In the free end region of the housing 10 and before the thread storage drum 14 as considered in the thread running direction, a combined thread braking and knot monitoring unit 21 is provided. It will be explained in detail later on in connection with FIGS. 2–4. The unit 21 is located on the lower side of the housing 10. The thread is supplied to the unit through an immediately preceding thread guiding eye 22 which is arranged on an end of a vertical throughgoing passage of the housing. The passage is formed at least partially by an insert sleeve 23 which is shown in FIG. 2 and receives an end of a thread guiding pipe 24. The thread guiding eye 22 is ring-shaped in this embodiment and is positioned so that a central axis perpendicular to the plane of the eye which is coincident with thread 20 downstream of the first roller in the drawing passes substantially adjacent to the first roller 25.

The combined thread braking and knot monitoring unit has two cylindrical rollers 25 and 26 which cooperate with one another and have parallel axes. The rollers 25 and 26 have smooth surfaces. The rollers are supported on axle journals 27 and 28 so that one roller is at least partially pivotally mounted so that it can be swung or pivoted to or from the other roller. The axle journal 27 for the roller 25 is mounted on the housing 10. The axle journal 28 for the roller 26 is mounted on a free end of a bent lever 29 which is turnable about an supporting means axle 30 in the housing 10. The roller 26 supported on the turning lever 29 is arranged with a greater axial distance from the thread guiding eye 22 than the rigidly supported roller 25, as considered in an axial direction of the thread guiding ear 22. The periphery of the rigidly supported roller 25 projects at least approximately to the longitudinal axis of the thread guiding eye 22, so that the thread 20 which comes through the thread guiding pipe 24 practically runs without contact with the thread guiding eye 22 onto the roller 25 which simultaneously form a deviating roller for the thread.

Two threaded holes are provided near one another on the lower side of the housing 10 for adjusting screws 31 and 32. Both threaded openings extend to the region of a portion 29.1 of the bent turning lever 29 which is mounted in a slot of the housing 10. Portion 29.1 extends horizontally in FIG. 2. The helical pressure spring 33 is arranged in one opening and abuts with its one end against the portion 29.1 of the turning lever 29 and with its other end against the adjusting screw 31. The adjusting screw 32 in the other threaded opening forms with its inner end 32.1 an abutment which limits the turning movement of the bent turning lever 29.

Figure 3:
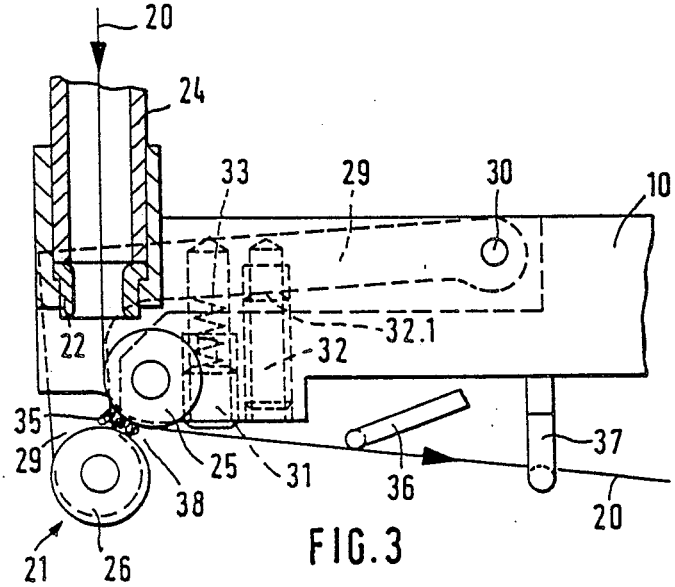
FIG. 3 is an elevational view substantially corresponding to the view of FIG. 2 and showing introduction of a thread knot into a combined braking and knot monitoring unit of the inventive device.
Figure 4:
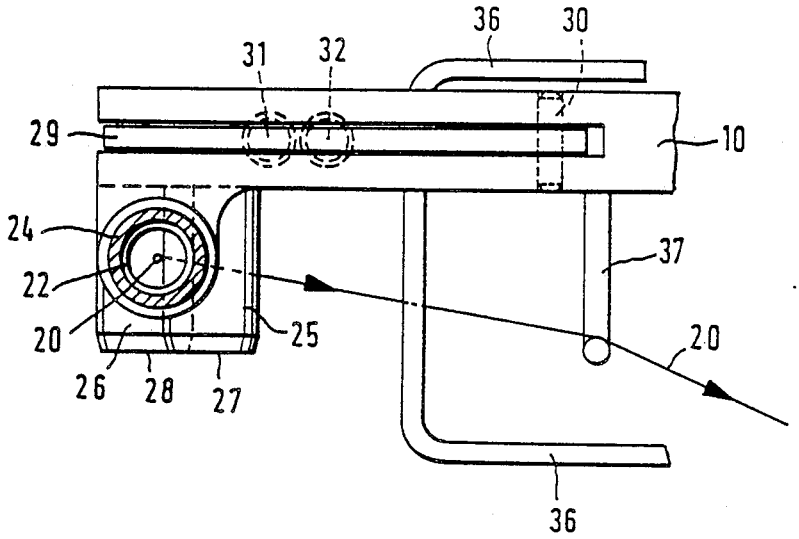
FIG. 4 is a plan view of the front end region of the thread storing and supplying device of the invention shown in FIGS. 2 and 3.

The adjusting screw 31 can adjust the tension of the helical pressure spring 33 which acts on the turning lever 29 and thereby determines the braking force which is applied to the thread 20 running between the rollers 25 and 26. The other adjusting screw 32 determines with its abutment end 32.1 a maximum gap 38 which can be produced between both rollers 25 and 26 when a knot 35 formed in the thread 20 forces apart the rollers 25 and 26, as shown in FIG. 3. When knot 35 is thicker than the width of the adjusted gap 38, it cannot pass between the rollers 25 and 26. Therefore, the rollers 25 and 26 simultaneously form a knot monitor. The first and second adjustment screw are part of an adjusting means for independently adjusting the spring force and the movable abutment.

A thread breakage monitor is arranged between the combined thread braking and knot monitoring unit 21 and the thread storage drum 14 in a known manner. The thread breakage monitor is a sensing bracket 36 which abuts against a thread running toward the storage drum 14. Depending on the braking force adjusted on the adjusting screw 31, the thread 20 on the sensing lever 36 can run with a deviation as shown in FIG. 1 or without a deviation as shown in FIGS. 2 and 3. Thread 20 passes through a thread guiding bracket 37 before the thread storage drum 14.

By "thread guiding element" we mean a part designed to guide or deflect the thread moving toward the rollers. In this embodiment the thread guiding element is the thread guiding eye 22.

It will be understood that each of the elements described above, or two or more together, may also find a useful application in other types of constructions differing from the types described above.

While the invention has been illustrated and described as embodied in a thread storing and supplying device for textile machines, especially knitting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A thread braking device for thread in textile machines especially knitting machines, comprising:

a housing;

supporting means mounted in said housing so as to be movable relative to said housing;

a first roller rotatably mounted in said housing;

a second roller rotatably mounted in said supporting means parallel and spaced from said first roller and defining a gap for said thread;

a spring acting on said supporting means for urging with its spring force said second roller against said first roller;

a movable abutment associated with said supporting means and establishing a maximum value for said gap between said rollers; and means for adjusting said spring force of said spring and said movable abutment independently of each other.

2. A thread braking device according to claim 1 further comprising a supporting means axle for said supporting means about which said supporting means is rotatable.

3. A thread braking device according to claim 1 where in said means for adjusting comprises a first adjustment screw inserted in a first threaded hole provided in said housing, said spring being connected between said supporting means and said first adjustment screw.

4. A thread braking device according to claim 3 wherein said means for adjusting further comprises a second adjustment screw inserted in a second thread hole provided in said housing, said movable abutment comprising an end of said second adjustment screw.

5. A thread braking device according to claim 4 wherein said adjustment screws are located at different distances from said supporting means axle.

6. A thread braking device according to claim 1 further comprising a plurality of axle journals fixed in said housing, and in said supporting means, said rollers being rotatably mounted on said axle journals.

7. A thread braking device according to claim 1 further comprising a thread guiding element provided on said housing.

8. A thread braking device according to claim 1 further comprising a thread guiding pipe and an insert sleeve fastened to said housing, said insert sleeve receiving said thread guiding pipe.

9. A thread braking device according to claim 7 further comprising an insert sleeve fastened to said housing and said thread guiding element comprises a thread guiding eye located at one end of said sleeve.

10. A thread braking device according to claim 9 wherein said thread guiding eye has a central axis passing substantially adjacent to said first roller.

* * * * *